US005277491A

United States Patent [19]

Burnett et al.

[11] Patent Number: 5,277,491

[45] Date of Patent: Jan. 11, 1994

[54] APPARATUS AND METHOD FOR DISPENSING A SLURRY

[75] Inventors: Tom M. Burnett; Wade L. Burnett; C. Hugh Burnett, all of Campobello, S.C.

[73] Assignee: Burnett Lime Co., Inc., Campobello, S.C.

[21] Appl. No.: 792,682

[22] Filed: Nov. 15, 1991

[51] Int. Cl.[5] ..... B28C 7/16

[52] U.S. Cl. ..... 366/51; 366/194

[58] Field of Search ..... 366/150, 136, 137, 302, 366/307, 3, 5, 33, 34, 40, 42, 51, 136, 137, 138, 184, 190, 195, 194, 262

[56] References Cited

U.S. PATENT DOCUMENTS

| | | | |
|---|---|---|---|
| 954,103 | 4/1910 | Irey | 366/137 |
| 3,034,543 | 5/1962 | DuBois . | |
| 3,145,881 | 8/1964 | Moore . | |
| 4,320,012 | 3/1982 | Palm . | |
| 4,329,090 | 5/1982 | Teague . | |
| 4,440,499 | 4/1984 | Tomikawa | 366/3 |
| 4,708,745 | 11/1987 | Schonhausen | 366/3 |
| 4,810,659 | 3/1989 | Higo . | |
| 4,824,022 | 4/1989 | Hillemeier | 366/3 |
| 4,955,723 | 9/1990 | Schneider | 366/136 |
| 5,046,855 | 9/1991 | Allen | 366/137 |

OTHER PUBLICATIONS

Pennwalt, Joseph L. Beals, Title "Mechanics Of Handling Lime Slurries", pp. 1-19 Oct. 1976.

Porta Batch, Title "Porta Batch A Revolutionary New Portable Lime Slaking System" 1982.

Pulsafeeder, Title "Pulsa Series-Diaphragm Metering Pumps" date Jun. 1986, Rochester, NY.

*Primary Examiner*—Robert W. Jenkins

*Attorney, Agent, or Firm*—Carter and Schnedler

[57] ABSTRACT

There is provided an apparatus and method for dispensing a lime slurry from a storage tank. The lime slurry is continuously agitated in the tank. A conduit connects the bottom portion of the tank to an elevated pump. At least the portion of the conduit near the tank is at an angle of at least 30° with respect to the horizontal so that lime particles will not tend to clog the conduit. The passage portion of the pump is continuous and straight to also reduce the probability of clogging. A source of fluid under pressure is connected to the output of the pump providing a back pressure on the pump, increasing the velocity of the slurry, and further diluting the slurry.

28 Claims, 2 Drawing Sheets

APPARATUS AND METHOD FOR DISPENSING A SLURRY

BACKGROUND OF THE INVENTION

This invention relates to a method and apparatus for dispensing slurries of material having substantial suspended solids. More particularly it relates to a method and apparatus for dispensing lime slurries for the treatment of water.

Lime has been used for many years to treat both drinking water and waste water, primarily for the purpose of increasing the alkalinity of the water, i.e. neutralizing the acidity in the water to reduce damage to water handling equipment associated with low pH's. As the acidity in rainwater has increased throughout the industrialized world the importance of the use of lime for neutralizing the acid has increased.

Lime which is utilized in water treatment comes in two forms, namely quick lime, which is normally calcium oxide, and hydrated lime, which is normally calcium hydroxide. Calcium oxide is a white coarse solid which has a cubic crystalline structure and is made by heating high quality calcium carbonate. Calcium hydroxide is prepared by heating calcium oxide and by adding a small amount of water thereto, which forms a more stable hexagonal crystalline structure.

Calcium hydroxide or hydrated lime, which is the preferred form used in connection with systems for raising the pH of water, is slightly soluble in water but makes a suspension easily due to the small particle sizes. The resulting suspension and solution is strongly alkaline. Freshly slaked lime, that is, dry lime to which has been added a small amount of water consists of small particles which are about 10% more soluble in water than coarse particles or aged slaked lime. Commercial lime mixtures in water vary widely in regard to the settling rate of suspended particles. In general, one half of the particles will settle out in 90 minutes under laboratory conditions while the mixture is unagitated. As lime is slurried in a water mixture, the higher the amount of suspended solids the more difficult it is to achieve an even suspension. The accepted maximum lime slurry is 45% suspended solids which exhibits a thick, muddy texture. Normally a 30–35% suspended solid slurry has reasonable fluidity to allow transport and agitated storage.

Several factors affect the solubility of time in water. These factors include the amount of dissolved $CO_2$ in the water, the temperature of the water, and particle size of the lime. Since dry lime will react with moisture in the air, a slow reaction will occur between the lime and $CO_2$ in the air, forming water insoluble carbonates. Lime suspended in water will react with both bicarbonates and dissolved $CO_2$ to form more carbonates. Because of the ready formation of these carbonates, lime in a slurry form is very difficult to handle in a metering or dispensing system because of the scaling which occurs inside of the tanks and feed pipes due to the formation of calcium carbonate.

Piping lime slurry presents substantial challenge to the user. To avoid settling of the lime in pipes, the lime must travel from 2.5 to 8 feet per second depending on particle size. Because of lime's inherent pH of above 12, the water that carries the lime undergoes a softening action which precipitates fresh calcium carbonate as a dense hard scale. When this formation of calcium carbonate occurs in an undisturbed mass of settled lime, crystallization among the closely packed particles binds them together in a rigid mass that clings tenaciously to solid material with which it was in contact during the reaction, such as, for example, the walls of pipes. If unattended or poorly engineered, the scale will ecrete to the point that the lime will close the pipe. Thus blockage of openings and passageways occurs if the slurry is not kept in a constant motion.

The types of piping for feeding lime slurry is quite restrictive. Since lime will react with water and $CO_2$ forming calcium carbonate scale, feed lines must be designed to avoid scale buildup. The poorest feed lines are those of metal because interior rough surface areas found in metal pipes provide numerous sites for ecretions and thus scaling to begin. Preferred pipes are flexible plastic lines, such as PVC, with few or no elbows. These types of lines are smoother than metal and avoid caustic reactions which occur with certain metals. Also flexible plastic lines alloy for scaling to be externally removed by squeezing the pipe is a buildup begins. Elbows should be held at a minimum because of reduced flow rate as lime solids turn the corner of the elbow. The diameter of the piping is also important since smaller diameter pipes tend to clog more readily. In fact, it is commonly believed that small diameter pipes, i.e. in the ¾" range, cannot be readily used to meter or dispense lime slurry effectively without undue clogging.

OBJECTS OF THE INVENTION

It is therefore one object of this invention to provide an improved slurry dispensing system.

It is another object to provide a method and apparatus for dispensing lime slurry which is not prone to clog.

It is still another object to provide a method and apparatus for accurately metering lime slurry for treating water.

SUMMARY OF THE INVENTION

In accordance with one form of this invention there is provided an apparatus for dispensing a slurry containing an amount of solid material. The apparatus includes a tank which initially receives the slurry. The tank has upper and lower portions. There is an opening in the lower portion of the tank. One end of a conduit is connected to the opening. The other end of the conduit is connected to a pump. A substantial portion of the conduit is inclined with the end which is attached to the opening in the tank being at the lowest level. Preferably the pump is elevated above the opening. Thus the slurry may be pumped from the tank and any solid particles remaining in the conduit will flow back into the tank when the pumping ceases, thereby reducing the possibility of clogging. Preferably the tank is agitated to keep the slurry in suspension. Also it is preferred that the conduit diameter be large enough and its length short enough so that agitation will also occur within the conduit. The preferred slurry is a lime slurry. It is further preferred that the conduit be a plastic tube and at an angle of at least 30° with respect to the horizontal.

In another form of this invention there is provided an apparatus for dispensing or metering a slurry containing an amount of solid material including a tank for initially receiving the slurry. A pump having an input and output is provided. The input of the pump is connected to the tank through a tube. A source of fluid under pressure is connected to the output of the pump thereby providing a back pressure on the pump, increasing the speed of the slurry from the output of the pump, and further diluting the slurry. If the source of fluid, such as water, is nigh in $CO_2$ and if the slurry is a lime slurry, a removable reaction chamber may be connected to the output of the pump and to the source of fluid to permit calcium carbonate to form in the reaction chamber rather than in other places in the apparatus.

In accordance with another form of this invention there is provided a method of dispensing lime including the steps of: forming a lime slurry having solid content of less than 35%; adding the slurry to a tank; agitating the slurry in the tank wherein most of the solids remain substantially suspended; permitting the slurry to flow out of the tank from an opening in the lower portion thereof; pumping the slurry from the tank through a first tube connected to the opening in the tank with a pump which is elevated from the opening.

BRIEF DESCRIPTION OF THE DRAWINGS

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENT

Figure 1:
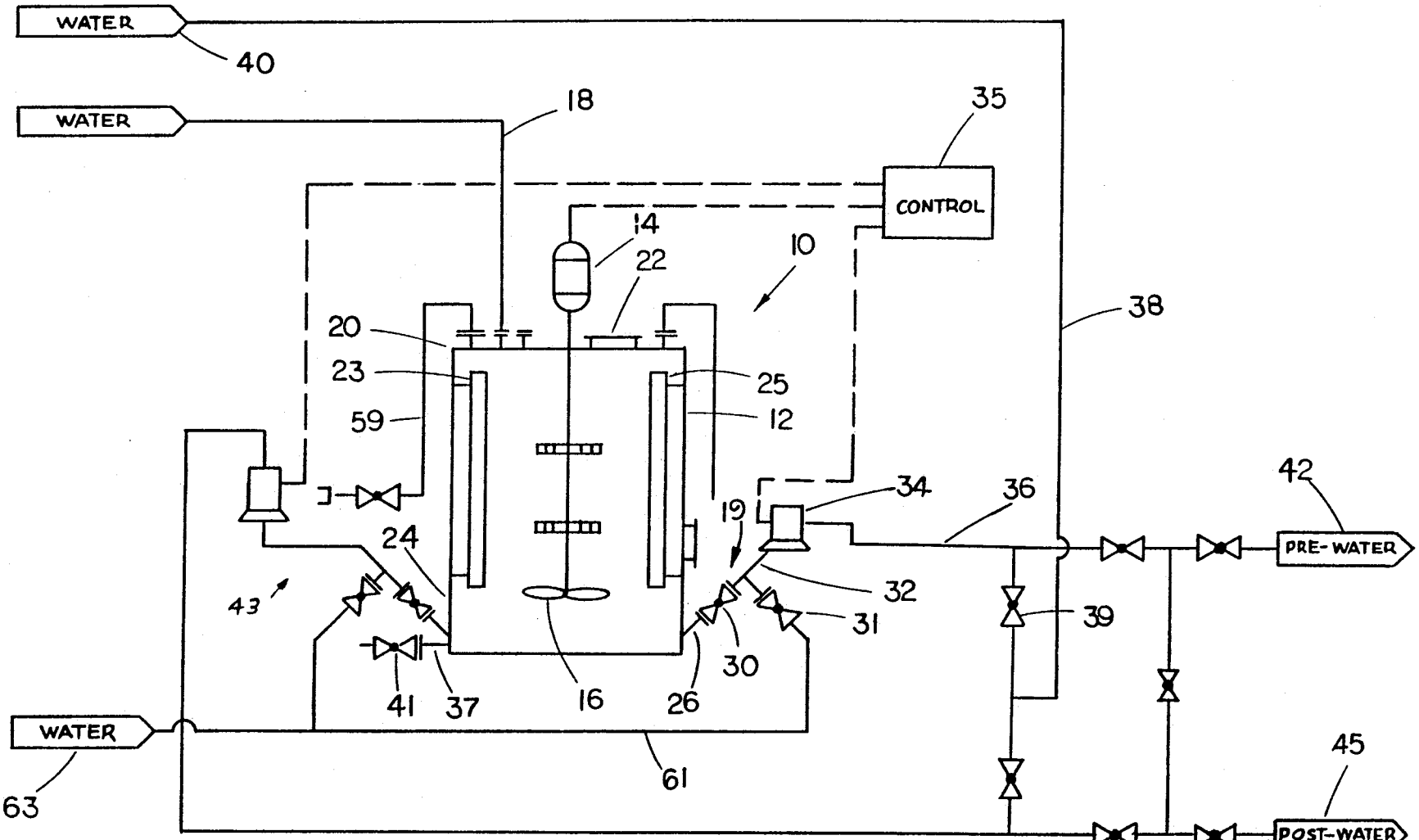
FIG. 1 is a schematic diagram showing the metering system of the subject invention.
Figure 2:
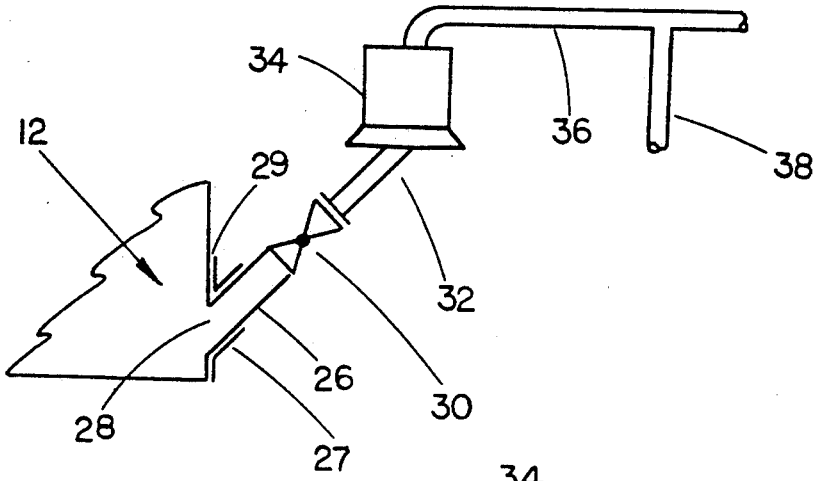
FIG. 2 is a simplified side elevational view showing portions of the apparatus of FIG. 1.

Referring now more particularly to FIGS. 1 and 2, there is provided lime slurry dispensing or metering system 10 including holding tank 12 for holding and receiving the lime slurry. Preferably the lime slurry is calcium hydroxide having 10–15% solids with the remainder being water. Mixer agitator 14 includes propellers 16 to keep the lime slurry in a suspension. In order to maintain the slurry in suspended form, the velocity of rotation of the propellers should be between 45 and 100 rpm's. The tank also includes baffles 23 and 25 to assist in maintaining the slurry in a suspended state.

A fresh water input tube 18 is connected to the top portion 20 of tank 12. Line 59 is connected to the top 20 of tank 12 for adding lime to the tank in concentrated (30% to 35% solids) slurried form.

Conduit 19 includes tube 26, valve 30, and tube 36. Tube 26 is connected to the bottom portion 24 of tank 12 through opening 28 in the wall of the tank by means of connector flange 27 which is bolted to O-ring 29 which may be welded or bolted to the tank. Preferably tube 26 is inclined 45° from the horizontal although an acceptable range of inclination from the horizontal is from 30°–65°. Tube 26 should be at least one inch in diameter and should be no longer than two feet between its connection at opening 28 to its connection to valve 30, although it is preferred that the length of tube 26 be no more than six inches. This short length and relatively large diameter is provided so that the lime slurry which exists within tube 26 will be agitated by the action of the propellers 16. Tube 26 is at an angle as set forth above so that any solid materials remaining in the tube will flow back into the tank for further agitation rather than remaining in the tube which could clog the tube by the formation of calcium carbonate scale. Pump 34 is located approximately two vertical feet above opening 28.

A second tube 32 is connected to the other side of valve 30 and to pump 34. This tube may be a smaller diameter than tube 26, however it is preferred that the diameter be at least ¾". The diameter of this tube is governed by the diameter of the input connector 51 of pump 34.

The output of pump 34 is connected to tube 36. Tube 32 and tube 26 as well as the other tubes set forth herein are preferably flexible PVC. PVC tube 38 is connected to tube 36. Tube 38 is further connected to a source of fresh water 40 which is under pressure, preferably 60 psi. Water pressure in tube 38 provides a back pressure to the pump 34 so that lime slurry is not inappropriately siphoned through the pump. The pressurized water from tube 38 also increases the velocity and forces the lime slurry along tube 38 to water to be treated such as pre-water stage 42.

Pump 34 is operated by control panel 35 so that to predetermined amounts of lime slurry may be metered into line 36. Control panel 35 also controls mixer agitator 14 as well as the pump for the post-water 45. Control panel 35 is of a type known to those skilled in the art for pump and motor control, the details of which do not form a part of this invention.

The water in line 38 is applied to line 36 through valve 39 which is normally open. Tube 27 is connected to a water source 29 and to tube 32 through valve 31 so as to enable the tube 32 to be cleaned out when the system is not operating.

There is also provided a drain tube 37 which is connected to an opening in lower portion of 24 of the tank 12 so that the tank may be drained. Another tube/pump system 43, which is identical to the one described above, is provided for redundancy to the system or to provide post-water treatment, as indicated by box 45.

The system described above will maintain the necessary lime slurry flow rate of 2.5 to 8 feet per second except for the flow in tube 26. However, with tube 26 being at least at a 30° angle with respect to the horizontal as described above, gravity will cause particles of lime to fall back to the bottom of tank 12.

Figure 3:
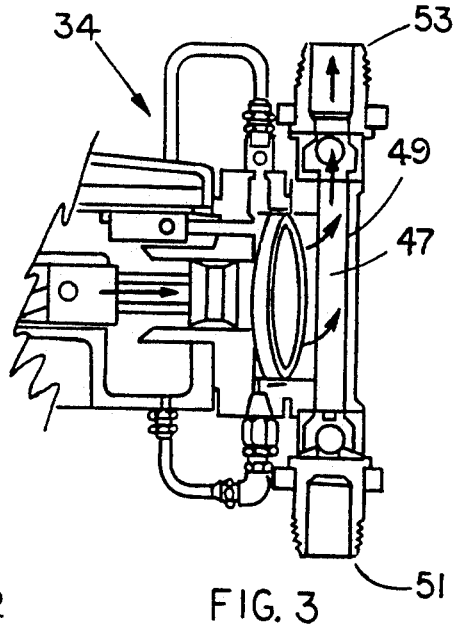
FIG. 3 is a sectional view showing a portion of the pump of FIG. 1 in the discharge mode.

Referring now more particularly to FIG. 3, it is preferred that pump 34 have a straight flow path therethrough so as to reduce the probability of clogging. Furthermore, it is preferred that the pump be a diaphragm type of pump. An acceptable diaphragm type pump is a Pulsa pump available from the Pulsafeeder Company of Rochester, N.Y. Pump 34 has a straight flow through path 47. Preferably the pump includes tube 49 made of tetrafluorethylene to further reduce flow restrictions and clogging. The pump includes input connector 51 to which tube 32 is connected, as shown in FIGS. 1 and 2, and output connector 53 to which tube 36 is connected, again as shown in FIGS. 1 and 2. The remainder of the diaphragm pump and its controls are not further explained as they are well-known to those skilled in the art.

There should be no back pressure valve present at the output 53 of the pump 34 or in line 36 which would provide a site for clogging. Pump 34 may be adjusted to feed from 3 to 60 gallons per hour to adjust the pH of the water to be treated.

The dispensing or metering system described above operates as set forth below. A lime slurry is first prepared under high pressure from hydrated lime mixed with water. This process is done primarily to prevent clumping. At this stage the concentration of the lime is preferably 30–35% solids. The concentrated lime slurry is then pumped through line 59 into tank 12. Water is then added to the lime slurry in the tank through line 18, thereby diluting the slurry so that the concentration is approximately 10–15% solids. The diluted lime slurry is agitated by propellers 16 at a rotation velocity between 45 and 100 rpm's. The lime slurry should be maintained at a temperature above 32°.

When it is time to treat the water supply 42 with the lime, valve 30 is opened and pump 34 is turned on, all the while the lime slurry in the tank 12 and in tube 26 is being agitated by propellers 16. The lime slurry flows up tube 26 through valve 30 into tube 32 and through tube 47 of pump 34. When the pump is in its discharge mode as shown in FIG. 3, the lime slurry flows out of the pump into tube 36. Water flows from reservoir 40 through tube 38 and valve 39 to tube 36 into the water supply 42. When the pump is in its suction mode or is turned off, the water pressure in tube 38 and thus tube 36 provides a back pressure against the output 53 of pump 34. Because of this back pressure lime slurry does not pass through the pump in the suction mode or while the pump is not operating and thus precisely metered amounts of lime are moved through the pump and to the water to be treated. Any large particles of lime which go into tube 26 will fall back into tank 12 due to gravity.

Pump 34 should have a hydraulically driven diaphragm chamber. All valves in the system should be fully opened or fully closed to prevent clogging.

Figure 4:
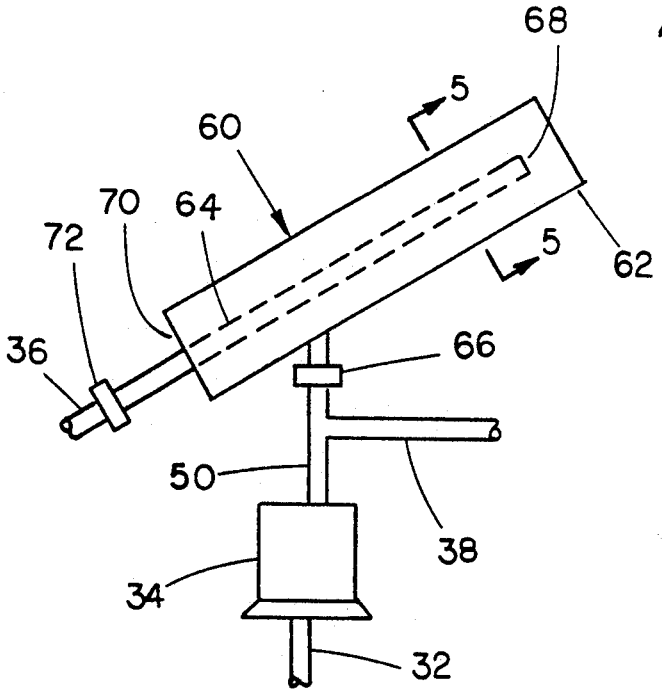
FIG. 4 is a partial side elevation showing an alternative to the embodiment of FIG. 1.
Figure 5:
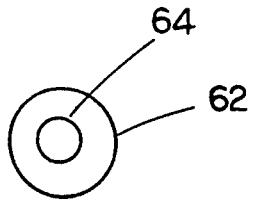
FIG. 5 is a sectional view of a portion of the embodiment of FIG. 4 taken through section line 5—5.

If water source 40 contains a high level of $CO_2$it is possible that the lime in the slurry in line 36 will react with the $CO_2$ and form calcium carbonate thereby clogging line 36. Therefore in high $CO_2$ environments a removable reaction chamber 60 may be connected to output 50 of pump 34 and to tube 38 as shown in FIG. 4. Reaction chamber 60 includes a large diameter outer tube 62 and a small diameter inner tube 64. Output 50 is connected to tube 64 by union 66. Inner tube 64 includes open end 68. Inner tube 64 is fastened to outer tube 62 by reducer 70. Inner tube 64 is connected to tube 36 by union 72. Most of the formation of calcium carbonate should occur inside the reaction chamber 60. Unions 66 and 72 enable the reaction chamber 60 to be easily removed for periodic cleaning so that the calcium carbonate will not clog the system.

Thus a system is provided for precisely dispensing or metering lime to a water system without the clogging problems which have been experienced in the past. It is particularly applicable to smaller systems where large pipes are not utilized.

From the foregoing description of the preferred embodiments of the invention it will be apparent that many modifications may be made therein without departing from the true spirit and scope of the invention.

We claim:

1. An apparatus for dispensing a slurry containing an amount of solid material comprising:

a tank for initially receiving said slurry; said tank having upper and lower portions; an opening in the lower portion of said tank;

a conduit; said conduit having first and second open ends; said first end of said conduit connected to said opening;

a pump; said second end of said conduit connected to said pump; a portion of said conduit near said opening being a tube; said tube connected to said opening; said tube being inclined upwardly from said opening at an angle of at least 30° from horizontal, with the place of connection of said tube to said opening being the lowest level of said tube.

2. An apparatus as set forth in claim 1 wherein said solid material is lime.

3. An apparatus as set forth in claim 2 wherein said lime is hydrated lime.

4. An apparatus as set forth in claim 3 wherein said hydrated lime is calcium hydroxide.

5. An apparatus as set forth in claim 1 wherein the diameter of said opening in the lower portion of said tank and the diameter of said conduit is at least one inch.

6. An apparatus as set forth in claim 1 further including a second tube and a valve; said pump is connected to said second tube; said first tube being connected to said second tube through said valve.

7. An apparatus as set forth in claim 1 wherein said conduit is less than two feet in length.

8. An apparatus as set forth in claim 1 wherein said conduit is substantially straight.

9. An apparatus as set forth in claim 1 wherein said angle is between 30° and 65°.

10. An apparatus as set forth in claim 9 wherein said angle is 45°.

11. An apparatus for dispensing a slurry containing an amount of solid material comprising:

a tank for initially receiving said slurry; said tank having upper and lower portions; an opening in the lower portion of said tank;

a conduit; said conduit having first and second open ends; said first end of said conduit connected to said opening;

a pump; said second end of said conduit connected to said pump; at least a portion of said conduit near said opening being inclined upwardly from said opening with said first end of said conduit being the lowest level of said portion of said conduit; agitation means in said tank; said agitation means includes at least one propeller.

12. An apparatus for dispensing a slurry containing an amount of solid material comprising:

a tank for initially receiving said slurry; said tank having upper and lower portions; an opening in the lower portion of said tank;

a conduit; said conduit having first and second open ends; said first end of said conduit connected to said opening;

a pump; said second end of said conduit connected to said pump; at least a portion of said conduit near said opening being inclined upwardly from said opening with said first end of said conduit being the lowest level of said portion of said conduit; agitation means in said tank; said tank includes a plurality of baffles to enhance agitation.

13. An apparatus for dispensing a slurry containing an amount of solid material comprising:

a tank for initially receiving said slurry; said tank having upper and lower portions; an opening in the lower portion of said tank;

a conduit; said conduit having first and second open ends; said first end of said conduit connected to said opening;

a pump; said second end of said conduit connected to said pump; at least a portion of said conduit near said opening being inclined upwardly from said opening with said first end of said conduit being the lowest level of said portion of said conduit; said pump has a passage therein through which said slurry flows; said passage being substantially straight.

14. An apparatus as set forth in claim 13 wherein said pump is a diaphragm pump.

15. An apparatus for dispensing a slurry containing an amount of solid material comprising:

a tank for initially receiving said slurry; said tank having and upper and lower portions; an opening in the lower portion of said tank;

a conduit; said conduit having first and second open ends; said first end of said conduit connected to said opening;

a pump; the other end of said conduit connected to said pump; at least a portion of said conduit near said opening being inclined with the place of connection to said opening being at the lowest level; an output tube connected to the output of said pump; a source of fluid under pressure connected to said output tube thereby assisting the movement of said slurry through said output tube, providing a back pressure on said pump, and further diluting said slurry.

16. An apparatus as set forth in claim 15 further including a reaction chamber connected to said output of said pump and to said source of fluid under pressure.

17. An apparatus as set forth in claim 16 wherein said reaction chamber is removable.

18. An apparatus as set forth in claim 17 wherein said reaction chamber includes an inner tube and an outer tube; said outer tube enclosing at least a portion of said inner tube; a portion of said inner tube inside of said outer tube being open.

19. An apparatus as set forth in claim 15 wherein said fluid is water.

20. An apparatus for dispensing a slurry containing an amount of solid material comprising:

a tank for initially receiving said slurry; said tank having and upper and lower portions; an opening in the lower portion of said tank;

a conduit; said conduit having first and second open ends; said first end of said conduit connected to said opening;

a pump; the other end of said conduit connected to said pump; at least a portion of said conduit near said opening being inclined with the place of connection to said opening being at the lowest level; means for adding water under pressure to said conduit for cleaning said conduit.

21. An apparatus for dispensing a slurry containing an amount of solid material comprising:

a tank for initially receiving said slurry;

a pump; said pump having an input and an output; said input of said pump connected to said tank wherein said slurry may be removed from said tank in metered quantities;

a source of fluid under pressure connected to said output of said pump; conduit means connected between said tank and said pump; one end of said conduit means being connected to an opening in the lower part of said tank; said pump being elevated from the opening whereby said conduit means is an elevated angle from the horizontal.

22. An apparatus as set forth in claim 21 wherein said fluid under pressure is water.

23. An apparatus as set forth in claim 21 further including a reaction chamber connected to the output of said pump and to said source of fluid under pressure.

24. An apparatus as set forth in claim 23 wherein said reaction chamber includes an outer tube and an inner tube; at least a portion of said inner tube being enclosed by said outer tube; at least a portion of said inner tube inside of said outer tube having an opening.

25. An apparatus as set forth in claim 24 wherein said reaction chamber is removable.

26. An apparatus as set forth in claim 21 wherein said angle is greater than 30°; the diameter of portions of said conduit near said tank being at least one inch.

27. An apparatus as set forth in claim 21 wherein said solid material is lime.

28. An apparatus for dispensing a slurry containing an amount of lime comprising:

a tank for initially receiving said slurry; said tank having upper and lower portions; said tank including means for agitating the slurry in said tank; an opening in the lower portion of tank; conduit means; one end of said conduit means connected to said opening;

a pump; the other end of said conduit means connected to said pump; a portion of said conduit means near said tank being at an angle of at least 30° with respect to the horizontal; said pump having an input and an output;

a tube connected to said output of said pump; said tube further connected to a water source; said water source being under pressure; said water source providing back pressure for said pump and enhancing the flow of said slurry through said tube which is connected to the output of said pump; said pump including a passage; said passage being substantially straight; said conduit means being at least one inch in diameter near said opening in said tank; said conduit means being less than two feet in length.

* * * * *